US006093468A

United States Patent [19]

Toms et al.

[11] Patent Number: 6,093,468

[45] Date of Patent: Jul. 25, 2000

[54] FLEXIBLE LIGHTWEIGHT PROTECTIVE PAD WITH ENERGY ABSORBING INSERTS

[75] Inventors: Douglas Toms, St. Bernard; Andrew J. Wnuk, Wyoming; Dimitris I. Collias, Cincinnati, all of Ohio

[73] Assignee: The Procter & Gamble Company, Cincinnati, Ohio

[21] Appl. No.: 08/818,050

[22] Filed: Mar. 14, 1997

[51] Int. Cl.[7] ..... B44C 1/26; A41D 13/00

[52] U.S. Cl. ..... 428/67; 2/22; 2/411; 2/455

[58] Field of Search ..... 428/67, 116; 2/22, 2/23, 24, 411, 455

[56] References Cited

U.S. PATENT DOCUMENTS

| | | | |
|---|---|---|---|
| 1,165,669 | 12/1915 | Hedgcock | 188/213 |
| 1,229,947 | 6/1917 | Haggerty | 2/465 |
| 1,468,072 | 9/1923 | Ogle | 2/23 |
| 1,595,581 | 8/1926 | Stedman | 428/67 |

(List continued on next page.)

FOREIGN PATENT DOCUMENTS

| | | |
|---|---|---|
| 0 153 082 | 8/1985 | European Pat. Off. . |
| 0 490 137 A2 | 11/1991 | European Pat. Off. . |
| 269938 | 12/1944 | France . |
| 998 525 | 1/1952 | France . |

(List continued on next page.)

OTHER PUBLICATIONS

Tensile Impact Properties of Human Compact Bone, S. Saha, Dept. of Engineering and Applied Science, Yale University, and W.C. Hayes, Dept. of Applied Mechanics, Stanford University, Apr. 10, 1974. J. Biomechanics 1976. vol. 9 pp. 243–251.

Hip Fracture Risk During Gait, Lots, J.C., Hayes, W.C., Gerhart, T.N., Orthopaedic Biomechanics Lab., Dept. of Orthopaedic Surgery, Charles A. Dana Research Institute, Beth Israel Hospital and Harvard Medical School, Boston, MA., pp. 103–104.

(List continued on next page.)

*Primary Examiner*—Deborah Jones
*Assistant Examiner*—Bryant Young
*Attorney, Agent, or Firm*—Vanessa M. Nichols; Jacobus C. Rasser

[57] ABSTRACT

Disclosed is an improved protective pad for protecting the human body against impact forces. The pad is formed using layers of high density closed-cell polymer foam low density closed-cell polymer foam, and resilient or non-resilient energy absorbing inserts. The high density layer absorbs and shunts impact forces, while the low density layer acts as a cushion against the human body, and provides for comfort. The pad can be provided with a plurality of holes through its thickness to provide for breathability and release of heat from the human body, the surface area of the holes being great enough to allow for adequate ventilation but not so great as to significantly decrease the protection offered by the pad. The pad can also be provided with a plurality of score lines across its surface and partially through its thickness to provide for flexibility and conformability to the part of the human body being protected.

23 Claims, 5 Drawing Sheets

U.S. PATENT DOCUMENTS

| | | | |
|---|---|---|---|
| 1,740,171 | 12/1929 | Goldsmith | 2/465 |
| 1,756,358 | 4/1930 | Ingram | 2/465 |
| 1,774,739 | 9/1930 | Voyne | 2/465 |
| 1,786,268 | 12/1930 | Snavely | 2/465 |
| 2,247,961 | 7/1941 | Mulvey | 2/462 |
| 2,481,291 | 9/1949 | Coleman | 2/465 X |
| 2,663,020 | 12/1953 | Cushman | 2/455 |
| 2,745,106 | 5/1956 | Salhus | 2/215 |
| 2,889,830 | 6/1959 | Raymond | 2/465 X |
| 2,917,051 | 12/1959 | White | 2/210 X |
| 3,026,874 | 3/1962 | Stevens | 128/888 X |
| 3,044,075 | 7/1962 | Rawlings | 2/22 |
| 3,185,362 | 5/1965 | Wakefield | 224/155 |
| 3,304,938 | 2/1967 | Perkins, Jr. | 128/888 |
| 3,322,873 | 5/1967 | Hitchcock | 264/222 |
| 3,334,626 | 8/1967 | Schimmel | 128/888 |
| 3,435,946 | 4/1969 | Sobek et al. | 206/523 |
| 3,438,377 | 4/1969 | Connors | 450/104 |
| 3,446,880 | 5/1969 | Enicks | 2/465 X |
| 3,526,221 | 9/1970 | Garber | 128/95.1 |
| 3,528,416 | 9/1970 | Chamberlain | 128/888 |
| 3,550,159 | 12/1970 | Alarco | 2/465 X |
| 3,577,305 | 5/1971 | Hines et al. | 428/116 X |
| 3,609,764 | 10/1971 | Morgan | 2/414 |
| 3,713,640 | 1/1973 | Margan | 267/117 |
| 3,771,170 | 11/1973 | Leon | 2/97 |
| 3,833,259 | 9/1974 | Pershing | 297/452.27 |
| 3,848,802 | 11/1974 | Digginger et al. | 239/10 |
| 3,872,511 | 3/1975 | Nichols | 2/413 |
| 3,921,222 | 11/1975 | Hollman | 2/465 |
| 3,990,440 | 11/1976 | Gaylord, Jr. | 128/892 |
| 4,000,737 | 1/1977 | Horn | 128/888 |
| 4,023,569 | 5/1977 | Warnecke et al. | 128/888 |
| 4,067,063 | 1/1978 | Ettinger | 2/22 X |
| 4,134,399 | 1/1979 | Halderson | 128/888 |
| 4,151,613 | 5/1979 | Rhee | 2/465 |
| 4,185,327 | 1/1980 | Markve | 2/465 X |
| 4,219,892 | 9/1980 | Rigdon | 2/24 |
| 4,250,882 | 2/1981 | Adair | 128/888 |
| 4,272,850 | 6/1981 | Rule | 2/24 |
| 4,292,263 | 9/1981 | Hanrahan et al. | 264/46.9 |
| 4,346,205 | 8/1982 | Hiles | 528/53 |
| 4,354,280 | 10/1982 | Hayes | 2/16 |
| 4,370,754 | 2/1983 | Donzis | 2/22 X |
| 4,371,636 | 2/1983 | Distler et al. | 523/223 |
| 4,399,816 | 8/1983 | Spangler | 128/888 |
| 4,454,869 | 6/1984 | Byler | 606/240 |
| 4,472,839 | 9/1984 | Johansen | 2/338 |
| 4,536,539 | 8/1985 | Lundberg et al. | 524/521 |
| 4,538,301 | 9/1985 | Sawatski et al. | 2/467 |
| 4,547,919 | 10/1985 | Wang | 428/116 |
| 4,573,216 | 3/1986 | Wortberg | 2/22 X |
| 4,584,339 | 4/1986 | Lundberg et al. | 524/516 |
| 4,602,384 | 7/1986 | Schneider | 2/2.16 |
| 4,633,863 | 1/1987 | Filips et al. | 128/846 |
| 4,641,641 | 2/1987 | Strock | 128/846 |
| 4,654,396 | 3/1987 | Bung et al. | 524/401 |
| 4,700,403 | 10/1987 | Vacanti | 2/22 X |
| 4,737,994 | 4/1988 | Galton | 2/465 |
| 4,761,834 | 8/1988 | Kolb | 2/465 |
| 4,807,301 | 2/1989 | Ferber | 2/465 |
| 4,866,800 | 9/1989 | Bedford | 5/652.1 |
| 4,884,295 | 12/1989 | Cox | 2/2.5 X |
| 4,892,551 | 1/1990 | Haber | 623/23 |
| 4,905,681 | 3/1990 | Glascock | 128/888 |
| 4,917,112 | 4/1990 | Kalt | 128/888 |
| 4,926,503 | 5/1990 | Wingo, Jr. | 2/267 X |
| 4,926,883 | 5/1990 | Strock | 128/888 |
| 4,951,656 | 8/1990 | Gorka et al. | 602/7 |
| 4,977,893 | 12/1990 | Hunt | 128/846 X |
| 4,985,931 | 1/1991 | Wingo, Jr. | 2/462 |
| 5,027,801 | 7/1991 | Grim | 602/16 |
| 5,030,501 | 7/1991 | Colvin et al. | 428/178 |
| 5,034,998 | 7/1991 | Kolsky | 2/22 X |
| 5,037,880 | 8/1991 | Schmidt et al. | 524/823 |
| 5,054,121 | 10/1991 | Mitchell | 2/22 |
| 5,057,111 | 10/1991 | Park | 606/69 |
| 5,062,433 | 11/1991 | Kummer | 128/888 |
| 5,066,296 | 11/1991 | Chapman et al. | 606/64 |
| 5,070,865 | 12/1991 | Iams | 606/240 |
| 5,077,849 | 1/1992 | Farley | 5/730 |
| 5,098,124 | 3/1992 | Breed et al. | 280/751 |
| 5,098,421 | 3/1992 | Zook | 606/367 |
| 5,100,189 | 3/1992 | Futamata et al. | 293/132 |
| 5,105,473 | 4/1992 | Valtakari | 2/22 X |
| 5,111,542 | 5/1992 | Farley | 5/727 |
| 5,117,969 | 6/1992 | Roth | 198/807 |
| 5,122,146 | 6/1992 | Chapman et al. | 606/102 |
| 5,123,407 | 6/1992 | Dewhurst | 602/2 |
| 5,136,740 | 8/1992 | Kraft | 5/730 |
| 5,139,240 | 8/1992 | Miyamoto et al. | 267/140.13 |
| 5,150,767 | 9/1992 | Miller | 182/137 |
| 5,157,789 | 10/1992 | Klass | 2/114 |
| 5,160,785 | 11/1992 | Davidson, Jr. | 428/316.6 |
| 5,161,257 | 11/1992 | Arensdorf et al. | 2/22 X |
| 5,171,766 | 12/1992 | Mariano et al. | 523/218 |
| 5,173,964 | 12/1992 | Ball et al. | 2/461 |
| 5,178,811 | 1/1993 | Farley | 264/138 |
| 5,179,792 | 1/1993 | Brantingham | 36/29 |
| 5,184,409 | 2/1993 | Brown | 36/44 |
| 5,191,659 | 3/1993 | Backus | 2/227 |
| 5,191,752 | 3/1993 | Murphy | 54/44.5 |
| 5,205,815 | 4/1993 | Saunders | 602/19 |
| 5,218,720 | 6/1993 | Tolton | 2/97 |
| 5,230,947 | 7/1993 | Ou | 428/212 |
| 5,252,373 | 10/1993 | Ganske et al. | 428/68 |
| 5,257,418 | 11/1993 | Jaskiewicz | 2/20 |
| 5,265,296 | 11/1993 | Abbas et al. | 5/612 |
| 5,274,846 | 1/1994 | Kolsky | 2/460 |
| 5,277,697 | 1/1994 | France et al. | 602/16 |
| 5,284,468 | 2/1994 | Nelson | 602/5 |
| 5,327,597 | 7/1994 | Rothbard | 5/736 |
| 5,337,418 | 8/1994 | Kato et al. | 2/456 |
| 5,361,410 | 11/1994 | Sigl | 2/22 X |
| 5,383,920 | 1/1995 | Sikes | 607/112 |
| 5,426,786 | 6/1995 | Calvin | 2/465 |
| 5,437,618 | 8/1995 | Sikes | 602/19 |
| 5,604,021 | 2/1997 | Wagner | 428/218 |

FOREIGN PATENT DOCUMENTS

| | | |
|---|---|---|
| 63435 | 2/1914 | Germany . |
| 836 552 | 3/1952 | Germany . |
| 1 902 645 | 1/1969 | Germany . |
| 2 043 463 | 9/1970 | Germany . |
| 27 03 538 A1 | 8/1977 | Germany . |
| 26 25 514 | 12/1977 | Germany . |
| 35 30 397 A1 | 3/1987 | Germany . |
| 3638 718 A1 | 8/1987 | Germany . |
| 9102039 | 5/1991 | Germany . |
| 40 00 300 | 7/1991 | Germany . |
| 40 14 236 A1 | 11/1991 | Germany . |
| 40 35 966 A1 | 3/1992 | Germany . |
| 1002955 | 9/1965 | United Kingdom . |
| 2 082 919 | 3/1982 | United Kingdom . |
| WO 86/03655 | 7/1986 | WIPO . |
| 90/01883 | 3/1990 | WIPO . |
| WO 91/01658 | 2/1991 | WIPO . |
| WO 91/05493 | 5/1991 | WIPO . |
| WO 91/05494 | 5/1991 | WIPO . |
| 92/05717 | 4/1992 | WIPO . |
| 93/02577 | 2/1993 | WIPO . |
| WO 93/11678 | 6/1993 | WIPO . |

| | | |
|---|---|---|
| WO 93/15701 | 8/1993 | WIPO . |
| WO 94/12066 | 6/1994 | WIPO . |
| 96/19124 | 6/1996 | WIPO . |

OTHER PUBLICATIONS

The Use of Quantitative Computer Tomography to Estimate Risk of Fracture of the Hip From Falls by Jeffrey C. Lots, Ph.D. and Wilson C. Hayes, PH.D., Boston, MA, The Journal of Bone and Joint Surgery, vol. 72–A, No. 5, Jun. 1990.

Prediction of Femoral Impact Forces in Falls on the Hip, S.N. Robinovitch, W. C. Hayes, Nov. 1991, vol. 113, Journal of Biomedical Engineering.

Fall Severity and Bone Mineral Density as Risk Factors for Hip Fracture in Ambulatory Elderly, Susan L. Greenspan, MD; Elizabeth R. Myers, PhD; Lauri A. Maitland, MPH; Neil M. Resnick, MD; Wilson C. Hayes, PhD., JAMA Jan. 12, 1994, vol. 271, No. 2.

Hip Impact Velocities and Body Configurations for Experimental Falls From Standing Height, A. van den Kroonenberg, P. Munih, M. Weigent–Hayes, T.A. McMahon, 39th Annual Meeting, Orthopaedic Research Society, Feb. 15–18, 1993, San Francisco, CA.

Prevention Through Biomechanics Symposium Proceedings Centers for Disease Control—Bioengineering Center Dept. of Orthopaedic Surgery, May, 5–6 1994, Wayne State University.

Impact Near the Hip Dominates Fracture Risk in Elderly Nursing Home Residents Who Fall, W.C. Hayes, E. R. Myers, J. N. Morris, T. N. Gerhart, H.S. Yett, and L. A. Lipsitz, Calcified Tissue International (1993) 52:192–198.

An Empirical Strength Theory of Compact Bone, W.C. Hayes and T.M. Wright, Fracture 1977, vol. 3, ICF4, Waterloo, Canada Jun. 19–24, 1977.

Energy Shunting Hip Padding System Femoral Impact Force From a Simulated Fall to Below Fracture Threshold, W.C. Hayes, S.N. Robinovitch, T. A. mcMahon, Proc. of Third Injury Prevention Through Biomechanics CDC Symp. 1993.

A New Synthetic Rubber Norsorex® Polynorbornene, American Cyanamid Company R. F. Ohm and T. M. Vial—Presented at a meeting of the Rubber Division American Chemical Society, Cleveland, OH Oct. 4–7, 1977.

Polynorbornene: the porous polymer—Chemtech, Mar., 1980.

Flabbercast A Curative Polyurethane Gel, BJB Enterprises, Inc. Products.

Sorbothane Shaping Solutions to Design Problems.

Confor™ Foams and E–A–R Specialty Composites Technical Data Sheet TDS–13, Division, Cabot Safety Corporation.

Honeycomb CECORE® Polypropylene & Polyester Thermoplastic Honeycomb Data Sheet 8000 Hexcel Corporation, Pleasanton, CA Jan. 1996.

Honeycomb CECORE® Cush 'n Form Cushioning and Comformable Polypropylene Thermo–plastic Honeycomb Data Sheet 8100, Hexcel Corporation, Pleasanton, CA Jan. 1996.

Procter & Gamble Crash Phase 1 Review, Prepared by Crash Design Team, Continuum, Dec. 8, 1994.

U.S. application No. 08/616,536, Toms et al., filed Mar. 15, 1996.

FLEXIBLE LIGHTWEIGHT PROTECTIVE PAD WITH ENERGY ABSORBING INSERTS

FIELD OF THE INVENTION

The present invention relates to protective padding for the human body. The present invention has further relation to such protective padding that is lightweight, impact-absorbent, flexible, and breathable.

BACKGROUND OF THE INVENTION

Hip pads, and other protective padding, have been used for protecting the human body from damage due to impact from falls, accidents, sports, and other related events. In particular, bone fracture as a result of accidental falling is a common occurrence with elderly people, with people who have a osteoporosis, and people who are unsteady on their feet and have difficulty in walking. In elderly people, especially those with osteoporosis, bone fractures are very difficult to repair, and it is highly desirable to prevent them from occurring in the first place.

A variety of protective padding and garments have been made available in the past, but all with some shortcomings. A typical piece of protective wear is a pad that is either permanently fixed to a garment, or that slips into a pocket in the garment, or held in place by straps or a skin-safe adhesive so that the pad is positioned over a damage-prone area of the body. Such a damage-prone area, especially in the elderly, is the hip area. Hip fracture, which occurs in 2 to 3% of cases involving elderly fallers, generally involves fracture of the proximal end of the femur. This part of the femur consists of a head, neck, greater trochanter, and lesser trochanter. The greater trochanter projects outward at the most lateral area of the hip region and, being so located, is subjected to the brunt of impact force arising from a fall, in particular a sideways fall, onto the hip.

To protect the hip area, pads are typically fixed to the inside of clothing in the area that covers the hips, or are placed in pockets made in the clothing at the hip area. More specifically, the pads are typically positioned such that they overlie the greater trochanter, or, in the case of certain types of force or energy shunting pads, surround the greater trochanter without actually covering it.

The degree to which a pad needs to attenuate the force of impact during a fall is subject to much debate. This is because measurements of the force needed to fracture elderly cadaveric femurs in simulated fall loading configurations vary widely. These measurements range from 2110 Newtons (J. C. Lotz & W. C. Hayes, J. Bone Joint Surg. [Am], Vol. 72, pp 689–700, 1990) to 6020 Newtons (T. G. Weber, K. H. Yang, R. Woo, R. H. Fitzgerald, ASME Adv. Bioeng. BED22: pp 111–114, 1992) depending upon the rate of loading. In addition, the velocity at which a falling human torso impacts a hard surface such as a tile floor can vary from about 2.0 to about 4.5 meters/second. Average velocities of about 2.6 meters/second have been cited by researchers (S. N. Robinovitch, J. Biomech. Eng. Vol. 9, pp 1391–1396, 1994) who have measured the speed of human volunteers falling on their hips. Estimates of the force delivered to an unpadded greater trochanter during a fall also range widely from about 5700 Newtons to 10,400 Newtons (J. Parkkari et al., J. Bone and Mineral Res., Vol. 10, No. 10, pp 1437–1442, 1995).

The best evidence of pad effectiveness is obtained from clinical studies on living people. Such a study has been carried out by Lauritzen et al. (Lancet, Vol. 341, pp 11–13, 1993) using a hard shell-type pad. This pad was found to reduce incidence of hip fractures by about 50% in the population studied. In spite of these strong clinical results, the Lauritzen pad has been shown to provide relatively low force attenuation results when mounted on a surrogate hip and impacted by a heavy (35 kilogram) pendulum moving at a velocity of 2.6 meters/second (S. N. Robinovitch, et al., J. Biomechanical Engineering, Vol. 117, pp 409–413, 1995). Under these in-vitro test conditions, the Lauritzen pad reduced peak femoral force from about 5770 Newtons to about 4800 Newtons or only about 17%. A hip protector product based on the Lauritzen pad has been commercialized in Denmark by Sahvatex (a joint venture between Sahva A/S and Tytex A/S) under the tradename SAFE-HIP™. The hip protectors, which are oval-shaped structures containing plastic hard shells, are sewn into a pair of cotton underwear.

These clinical findings suggest two hypotheses. First is that the pendulum impact tests used by other investigators may not correlate well with pad performance in-vivo even though such tests may be useful in measuring the force reduction capabilities of various padding systems relative to one another. In such tests the pad is mounted on a surrogate hip which is held in a fixed position and struck laterally by a swinging mass weighing 35 kilograms or more. In an actual fall, the dynamics are somewhat different. In a fall, both the pad and human body mass are moving downward, in fact being accelerated downward due to gravity, and strike a fixed object such as the ground or a hard floor which does not move much in response. One would suspect that if an instrumented surrogate hip was dropped onto a hard surface, to better replicate fall dynamics, the rank ordering of various padding systems would probably be similar, but somewhat different percent force reduction results might be obtained. The second hypothesis assumes the pendulum test does correlate with in-vivo pad performance, and that even pads which provide relatively low levels of peak force reduction in-vitro (about 20% or so) can be effective in reducing hip fractures across a segment of the elderly population prone to falling. In either case, and regardless of test method, a pad which reduces peak force more than the clinically tested Lauritzen/Sahvatex pad should be even more effective in preventing hip fracture and protect an even broader segment of the elderly population.

Obviously, the more force reduction one obtains from a pad, the more likely it should reduce the incidence of hip fracture. However, our consumer research has taught us that, in addition to reducing the impact force exerted on the greater trochanter during a fall, pads must also provide other benefits to reinforce wearer compliance. These are related to both appearance and wearer comfort and include attributes such as maximum thickness, thickness profile, weight, breathability, flexibility, and conformability to the body, Prior pads have had many shortcomings in these areas.

Some prior art padding has been bulky and cumbersome in an attempt to provide for adequate protection from impact; many typical prior art pads purported to provide effective impact resistance are greater than 25.4 mm (1 inch) in thickness. Thin prior art pads typically provide low resistance from impact, characterized by less than about 30% peak force reduction as measured on surrogate hips either dropped or struck with heavy pendulums. Other padding has not been breathable, resulting in heat buildup on the skin that is covered by the pad. Still other padding has been stiff and rigid, thereby not conforming to the covered body parts. In addition, hard shell pads tend to be uncomfortable to sit on or sleep on when worn. Soft foam pads require greater thickness to absorb impact forces; the greater thickness results in a bulkier, less comfortable pad, and increased heat build up under the pad. All have resulted in relative discomfort to the users.

Our consumer research has shown that potential wearers, regardless of age or physical condition, are concerned with their appearance. Preferred are hip pads no thicker than about 25.4 mm (one inch), and more preferred are those about 19 mm (¾ inch) maximum thickness or less. Thickness profile is also important. Preferred are pads which are tapered from the area of maximum thickness to the perimeter such that neither the pad nor the pad edges show under normal clothing. A perimeter thickness range around the pad of 12.77 mm (½ inch) or less is generally preferred. Even more preferred is a perimeter thickness range of 6.35 mm (¼ inch) or less. Still even more preferred is a perimeter thickness range of 3.18 mm (⅛ inch) or less.

Since most potential wearers are elderly women of slender body habitus and low body mass, pad weight is a concern. Preferred are pads less than about 300 grams each (600 grams per pair). Even more preferred are pads which weigh less than about 200 grams each (400 grams per pair). Most preferred are pads which weigh less than about 100 grams each (200 grams per pair).

Unlike sports pads which are meant to be worn over very short periods of time, protective hip pads for the elderly are intended to be worn all day, indoors and outdoors, in all climates hot and cold, and across all humidity conditions. Typical foam pads are made from closed cell foams which do not pass moisture or perspiration from the body. In addition, such pads are thermal insulators and do not dissipate body heat effectively. This leads to even more perspiration and moisture buildup under the pad which can damage the skin of elderly wearers. Preferred pads thus have substantial open area, preferably at least about 5% or more, and more preferably about 10% or more, to permit evaporation of perspiration and to vent body heat.

Disclosed herein is a new, improved protective padding, that provides increased impact resistance in a relatively thin, lightweight pad. Increased impact resistance is maintained while providing breathability to prevent heat buildup and the associated discomfort. Additionally, this new pad provides for flexibility and conformance to the part of the human body being protected without any adverse impact on its protective qualities.

SUMMARY OF THE INVENTION

In accordance with the present invention there is provided a protective pad for protecting a predefined area of a human body against impact, the pad having a surface and a thickness, the pad comprising a layer of high density closed-cell polymer foam on the outer surface of the pad away from the wearer's body, and a layer of low density closed-cell polymer foam on the inner surface of the pad against the wearer's body. Typically, the high density foam has a density of from about 128 to about 192 kg per cubic meter (about 8 to about 12 pounds per cubic foot) and preferably about 160 kg per cubic meter (about 10 pounds per cubic foot). The high density foam typically has a Shore 00 Durometer hardness from about 72 to about 95. The low density foam typically has a density of from about 32 to about 80 kg per cubic meter (about 2 to about 5 pounds per cubic foot) and preferably about 64 kg per cubic meter (about 4 pounds per cubic foot). The low density foam typically has a Shore 00 Durometer hardness from about 40 to about 70. The layers are fixed together to provide a relatively lightweight pad providing relatively high resistance to impact forces and relative comfort to the user.

The pads of the current invention have one or more recesses to accept additional energy absorbing materials in the form of plugs or inserts. The recesses may be cut into the pad from the outer side of the pad extending a portion of the way through the pad, or situated within the internal structure of the pad and covered by the inner and outer foam layers. These recesses are generally located in or around the central area of the pad. The additional energy absorbing insert material or materials are selected to be of lower hardness, or lower stiffness, or lower compressive strength, or higher damping than the high density foam. Here, damping refers to a material's ability to dissipate impact energy internally, wherein much of the energy used to deform the material is dissipated directly into heat. The additional energy absorbing insert material or materials are selected from those groups comprising polyolefin or other polymeric foams, resilient rubber foams, high damping elastomers, high damping polyurethane compositions, curative polyurethane gels, polyvinyl chloride plastisol gels, viscoelastic foams, and related materials. Inclusion of such additional energy absorbing materials leads to a pad which is generally reuseable even after multiple impacts.

Disposable, one time use pads can also be constructed in accord with the current invention. In such cases the recess or recesses are filled with a crushable, non-resilient material such as expanded polystyrene foam or other plastic foam which is irreversibly crushable under the impact force of a fall.

The pad may have a plurality of score lines across the outer surface and partially through the thickness so as to provide substantial flexibility and conformability to the area of the human body covered by the pad, without significantly affecting resistance to impact forces. The scorelines may run through the insert material or materials or be positioned such that they do not run through the insert material or materials. The pad may also have a plurality of open areas on the surface and completely through the thickness so as to provide for breathability and dissipation of heat from the area of the human body covered by the pad, while maintaining significant resistance to impact forces.

In general, the pad weighs less than about 100 grams and has a maximum preferred thickness of less than about 25.4 mm. The overall size of the pad or area covered by the pad may range from about 96.7 to about 387.0 square cm (about 15 to about 60 square inches). The percentage of open area can range from about 5% to about 50% depending upon the overall size of the pad. In general, the pad's percentage of open area is selected so as to provide maximum ventilation while still providing about 40% or more peak force reduction as measured in a surrogate hip drop impact test. Preferred pads of the present invention meet or excede the 40% peak force reduction target at a pad weight of 100 grams or less; a minimum 40% force reduction is key to the present invention. Thus the ratio of % peak force reduction, as measured in a surrogate hip drop impact test, to pad weight in grams is about 0.4 percent per gram. More preferred are pads which meet or excede the 40% target at pad weights of 50 grams or less thereby providing at least 0.8% force reduction/gram. Most preferred are pads which meet the 40% target at pad weights of 30 grams or less thereby providing at least 1.33% force reduction/gram. Overall, the preferred range of the ratio of percent force reduction per gram weight of pad is from about 0.25 percent per gram to about 8.00 percent per gram. This ratio is more preferably from about 0.40 percent per gram to about 6.00 percent per gram.

Such pads can be either permanently or removably attached to a garment. The garments are preferably made of fabric which promotes wicking of perspiration buildup away from the human body.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1:
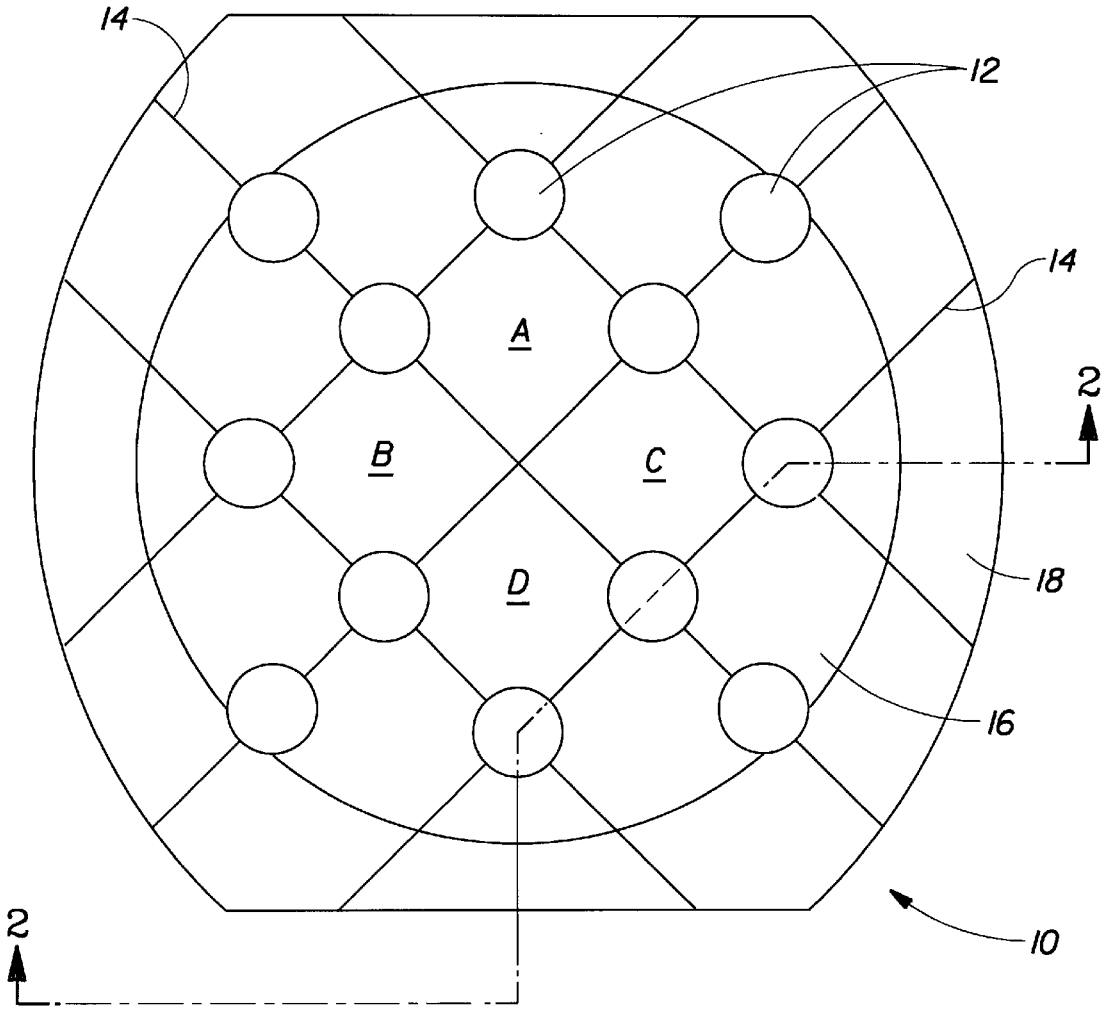
FIG. 1 is a plan view of a protective pad of the present invention.
Figure 2:
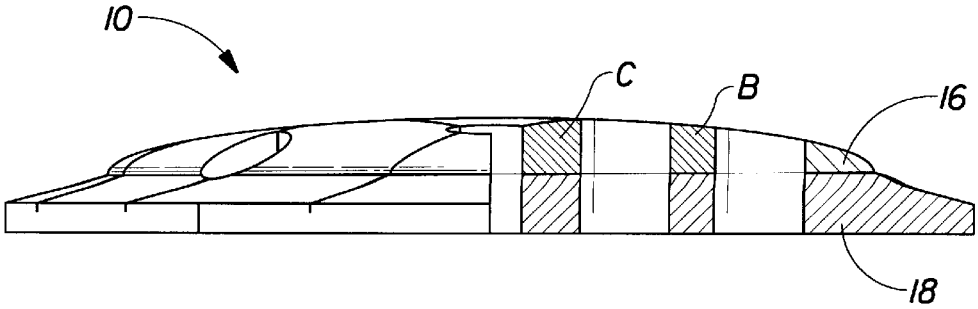
FIG. 2 is a partial cross-sectional view through lines 2—2 of FIG. 1.

Referring now to the drawings in detail wherein like numerals indicate the same element throughout the views, there is shown in FIG. 1 an embodiment of the present invention, protective pad 10. The protective pad 10 is relatively lightweight, and is relatively thin (less than 25 mm in thickness, but most preferably 19 mm or less). It also may be relatively flexible and contoured as required depending on specific use, as will be described in more detail hereafter. The pad 10 has a high degree of open area through its thickness for breathability while maintaining significant impact resistance, as shown by holes 12. The present pad 10 also effectively reduces the force of an impact at least 40% over the impact force experienced without protection as measured with an instrumented surrogate hip drop tester. FIG. 1 further shows the placement of an energy absorbing insert, segmented by scorelines 14 into four sections A, B, C, and D, forming a square insert located at about the center of the pad. In addition to square, the shape of the insert can be circular, oval, rectangular, triangular, pentagonal, hexagonal or any other shape. High density layer 16 forms the outside surface of the pad, and low density layer 18 forms the inside surface of the pad.

Figure 3:
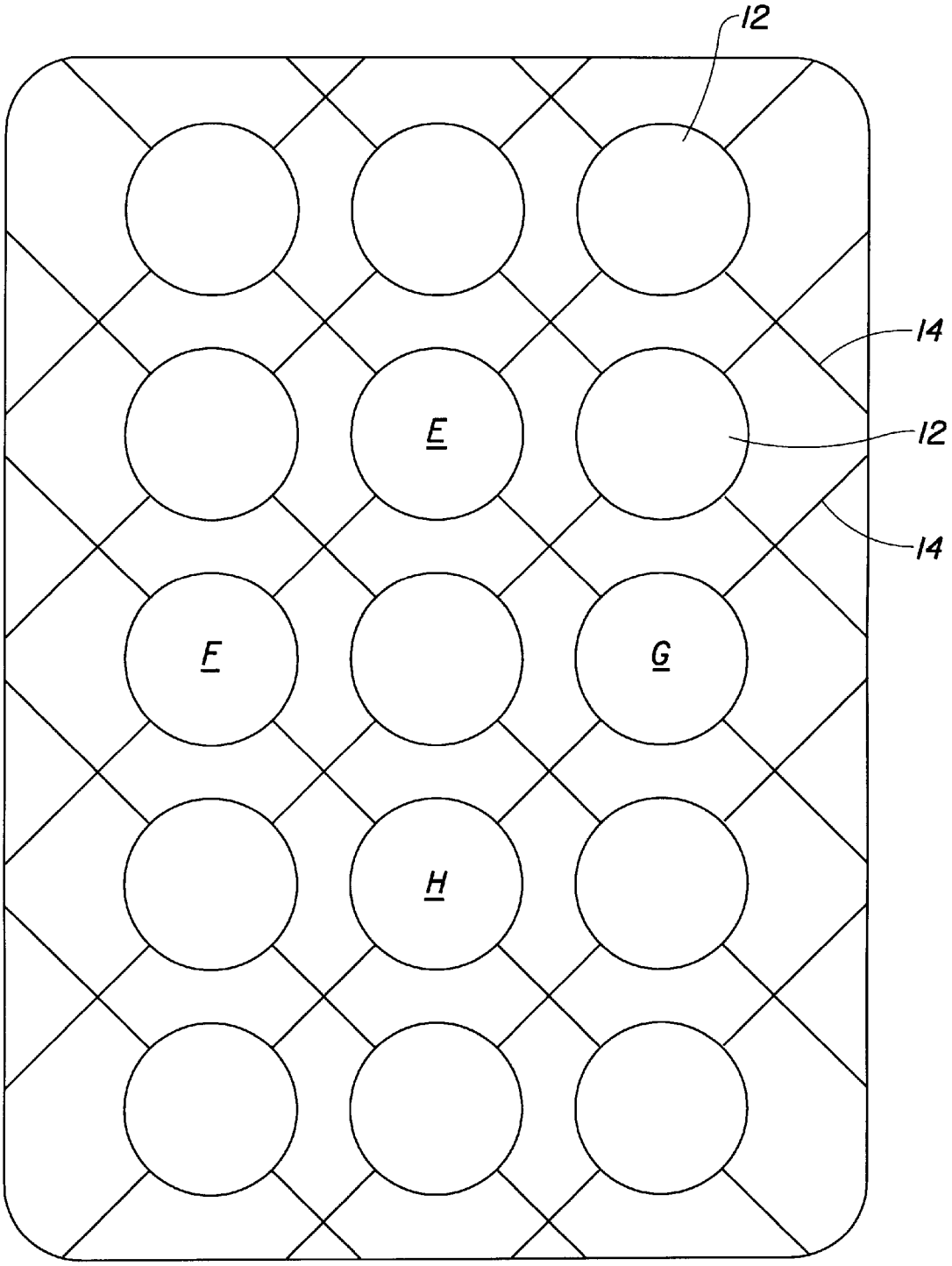
FIG. 3 is a plan view of an alternative embodiment of a protective pad of the present invention.

The pad 10 may be made in a variety of shapes based on the particular desired style and application, such as rectangular (as shown in FIG. 3), square, round, oval and the like. Multiple inserts E, F, G, and H are shown located about the center of the pad; one skilled in the art would envision a variety of other positions and configurations for these inserts. In FIG. 3, holes 12 provide for breathability, and scorelines 14 provide for flexibility and conformability to the protected area of the human body.

Figure 4:
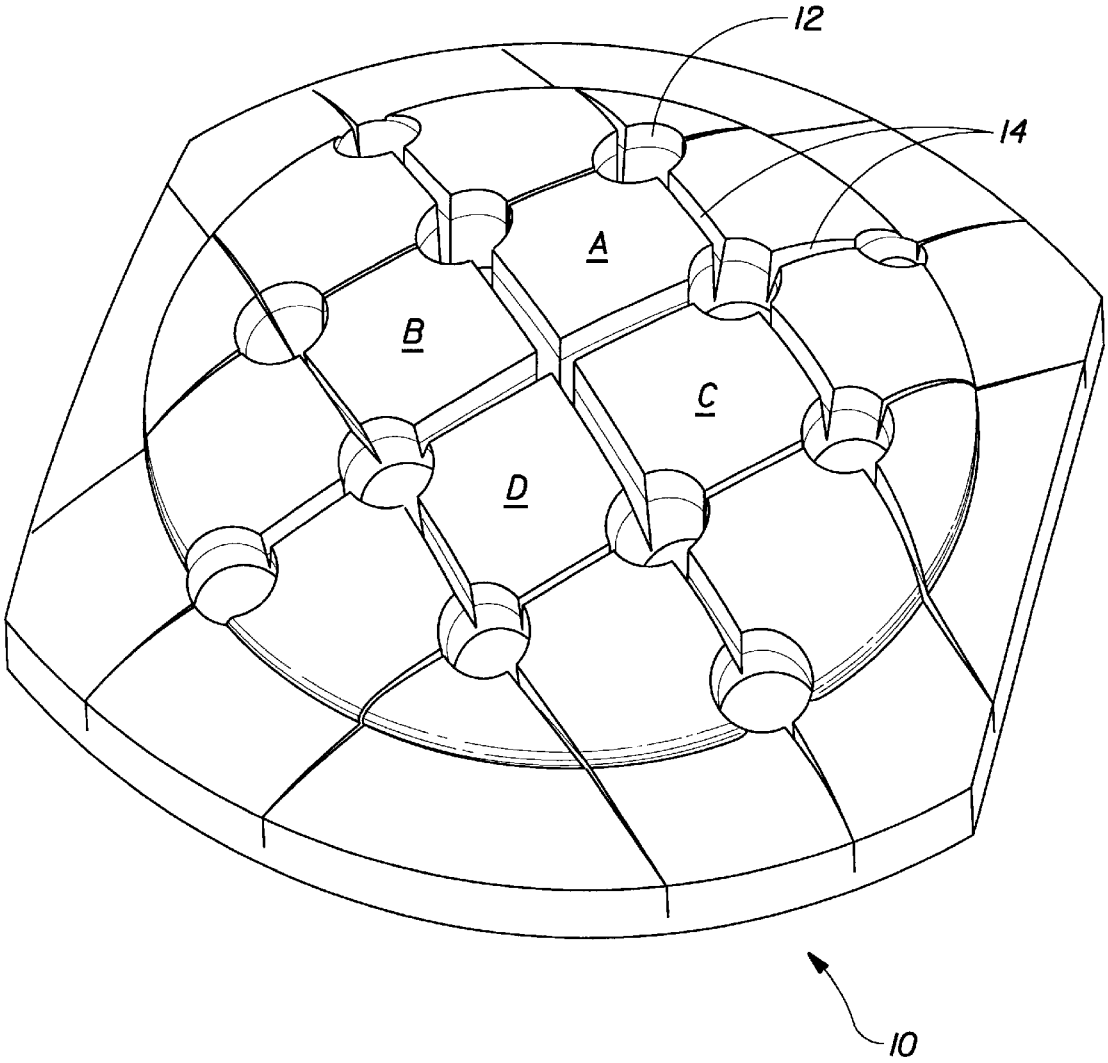
FIG. 4 is a perspective view of the hip pad of FIG. 1 showing the pad in a flexed position.

Holes 12, for breathability and dissipation of body heat under the pad, can range from about 3.18 mm to about 25.4 mm in diameter depending on the levels of breathability and impact resistance desired. Other shaped holes such as ovals, squares, and the like can also be employed. The surface area dedicated to holes 12 must be great enough to provide for sufficient ventilation, but not so great as to lower the peak force reduction capability of pad 10 to less than about 40%; the area dedicated to holes 12 may range from 5 to 50 percent of the total surface area while maintaining significant impact resistance. Pad 10 may be reticulated by slicing partially through its thickness, producing scorelines 14. Scorelines 14 are cut preferably from a depth of about ¼ to ¾ of the overall pad thickness, and across the surface area, as shown in FIGS. 1 and 3. Scorelines 14 are cut or molded into the pad from the outer surface or high density foam side of the pad. This makes the pad very flexible and able to conform to a wide range of shapes and sizes. The flexibility imparted by scorelines 14 is shown in FIG. 4.

The pattern and spacing in which the scorelines are applied can be varied. For illustrative purposes, FIGS. 1, 3, and 4 show the scorelines cut at + or −45 degrees to the straight edges of the pads and running through the centers of the holes in the pads. The scorelines can also be cut at 90 degrees to the straight edges of the pad or any angle between + and −45 degrees and 90 degrees to the edges. The scorelines can run through the holes, between the holes, or in combinations through and between the holes. The scorelines need not be cut as straight lines parallel and perpendicular to one another as shown in FIGS. 1, 3, and 4. They can also be cut in a fan shaped array from one side of the pad. They can be curved, sinusoidal, or zigzagged across the pad. Preferred spacing between the scorelines lies between about 6.53 mm and about 50.8 mm. Even more preferred spacing between the scorelines lies between about 12.77 mm and about 25.4 mm.

Figure 5:
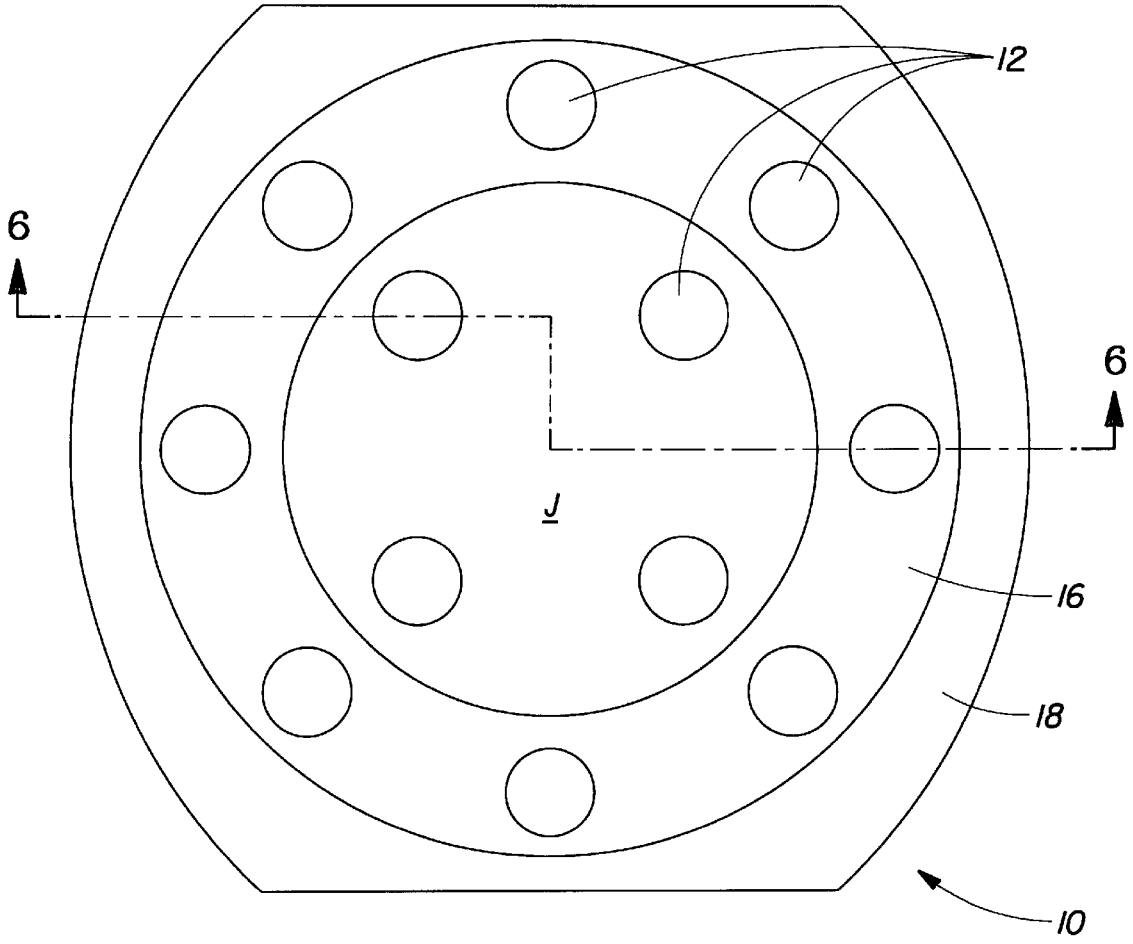
FIG. 5 is a plan view of another alternative embodiment of a protective pad of the present invention.
Figure 6:
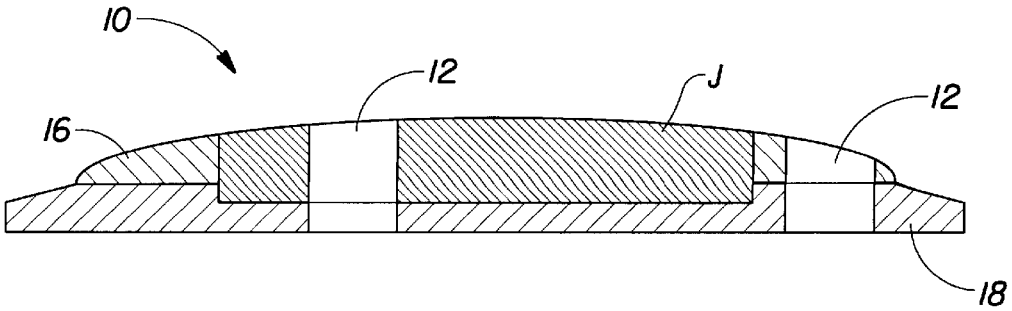
FIG. 6 is a partial cross-sectional view through lines 6—6 of FIG. 5.

FIG. 5 shows yet another embodiment of the current invention, in this case a pad containing a single circular insert "J" and without scorelines.

The pad is made with at least two different types of foam materials plus one or more insert materials placed in the pad recess or recesses. The outer impact layer 16 is a stiff high density material, preferably a closed-celled polymer foam, for example Voltek L1000 polyethylene foam (Voltek, Lawrence, Mass. 01843). According to the manufacturer, this material has a density of about 160 kilograms per cubic meter (10 lbs/cubic foot), a Shore 00 Durometer hardness of about 75, a compression strength of about 64 psi at 25% deformation, and a compression strength of about 97 psi at 50% deformation. The inner layer 18 is a soft low density cushion material, also preferably a closed-cell polymer foam, for example Sentinel MC3800 polyethylene foam (Sentinel Products Corporation, Hyannis, Mass. 02601). According to the manufacturer, MC3800 foam has a density of about 64 kilograms per cubic meter (4 lbs/cubic foot), a Shore 00 Durometer hardness of about 70.5, a compression strength of about 25 psi at 25% deformation, and a compression strength of about 42.8 psi at 50% deformation. The outer layer 16 absorbs impact force via compression and shunts impact force to the perimeter of the pad and is stiff enough to prevent the pad from bottoming out when under impact, while the inner layer 18 provides comfort and the degree of flexibility needed to conform to various parts of the human body. The end result is a combination of high force reduction, effectiveness, and comfort. The pad laminate 10 can be made by laminating the two layers together and then shaping it by mechanically grinding it, or using shaping rolls and a skiving blade. Alternatively, the pad can be made by heating the two layers and compressing them together under heat and pressure. Such manufacturing methods are known to those skilled in the art.

The foam layers are closed cell foams, preferably polyolefin closed cell foams, but other materials with similar properties can also be employed. Suitable polyolefin closed cell foams are derived from low density polyethylenes (LDPE), linear low density polyethylenes (LLDPE), medium density polyethylenes (MDPE), high density polyethylenes (HDPE), ethylene-vinyl acetate copolymers (EVA), ethylene methyl acrylate copolymers (EMA), ethylene ionomers, polypropylene and polypropylene copolymers. These polyolefin materials are preferred because they do not absorb water or perspiration, nor support microbial growth, and are generally non-irritating and non-sensitizing to the human skin. Suitable other materials can include rubber foams derived from natural rubber, butyl rubber, polyisoprene, polybutadiene, polynorbornene, styrene-butadiene, neoprene, nitrile rubber, and related rubber materials, polyurethane foams, and plasticized polyvinylchloride (PVC) foams. Although the other materials, like the polyurethanes or rubber foams, can perform at desirable impact resistance levels, care must be taken in selecting such materials for pads to be used in direct or indirect contact with human skin. Special grades of each, known to those skilled in the art, can be formulated to inhibit the absorption of water or perspiration, to prevent microbial growth, and to prevent skin irritation and sensitization, all of which lead to user discomfort or are detrimental to the user's health.

The outer layer 16 has a density of from about 128 to about 192 kg per cubic meter (about 8 to about 12 pounds per cubic foot) with about 160 kg per cubic meter (about 10 pounds per cubic foot) being the preferred density, and the inner layer 18 has a density of from about 32 to about 80 kg per cubic meter (about 2 to about 5 pounds per cubic foot) with about 64 kg per cubic meter (about 4 pounds per cubic foot) being the preferred density. The preferred values result in a combination of significant comfort and impact resistance in one pad. Additionally, providing a top or outer high-density layer with a thickness of at least 50 percent of the overall pad thickness maximizes performance of the pad.

The additional energy absorbing material positioned into the recesses in the pad structure can be selected from various materials, including (1) polyolefin or other plastic foams, (2) resilient rubber foams, (3) high damping rubbers, (4) high damping polyurethane compositions, (5) curative polyurethane gels, (6) high damping polyvinylchloride plastisol gels, (7) viscoelastic foams, or (8) resilient thermoplastic honeycomb laminates.

(1) Preferred polyolefin or other plastic foams are closed cell foams, selected from the group including low density polyethylenes (LDPE), linear low density polyethylenes (LLDPE), medium density polyethylenes (MDPE), high density polyethylenes (HDPE), ethylene-vinyl acetate copolymers (EVA), ethylene methyl acrylate copolymers (EMA), ethylene ionomers, polypropylene and polypropylene copolymers. These polyolefin materials are preferred because they do not absorb water or perspiration, nor support microbial growth, and are generally non-irritating and non-sensitizing to the human skin. It is generally preferred that the hardness or compression strength of the polyolefin or other plastic foam insert or inserts is less than that of the high density outer foam layer of the pad, preferrably less than about 72 as measured on the Shore 00 Durometer scale.

(2) Resilient foamed rubber inserts can be derived from natural rubber, butyl rubber, polyisoprene, polybutadiene, polynorbornene, styrene-butadiene, neoprene, nitrile rubber, and related rubber materials, polyurethane foams, and plasticized polyvinylchloride (PVC) foams. If the resilient foamed rubber insert is exposed to view on the outer side of the pad, it is generally preferred to select a closed cell foam to prevent water absorption during laundering. It is generally preferred that the hardness of the foamed rubber inserts is less than that of the high density outer foam layer of the pad, preferrably less than about 72 as measured on the Shore 00 Durometer scale.

(3) High damping rubbers include those families of solid rubber materials characterized by high loadings of oils, plasticizers, and fillers such as carbon black. The rubber itself can be based on synthetic or natural polyisoprene, polybutadiene, butyl rubber, polynorbornene, ethylene-propylene diene monomer (EPDM) rubber, styrene-butadiene rubber, and other rubbers known to those skilled in the art of rubber formulation. High damping properties are generally conferred through the incorporation of high levels of oils, plasticizers, and fillers such as carbon black. The formulation of high damping rubbers based on polynorbornene is described in "A New Synthetic Rubber Norsorex® Polynorbornene" presented by R. F. Ohm and T. M. Vial at the meeting of the Rubber Division, American Chemical Society, Cleveland, Ohio, Oct. 4–7, 1977) and "Polynorbornene: The Porous Polymer" (R. F. Ohm, Chemtec, March, 1980) both herein incorporated by reference. Preferred are those formulations which show high damping of impact force at room temperature and at deformation frequencies comparable to those experienced in a human fall to the ground. Examples of such materials derived from polynorbornene and butyl rubber can be obtained from Rubber Associates, Inc. (Barberton, Ohio 44203) in hardness ranges from Shore A Durometer 70 to about 30. Preferred for the current invention are high damping rubbers having a Shore A Durometer hardness of 50 or less. Even more preferred are high damping rubbers having a Shore A Durometer Hardness of about 40 or less.

(4) High damping polyurethane compositions are formed by the reaction of slightly branched, substantially linear polyols having hydroxyl endgroups and number average molecular weights in the range of 600 to 1200 grams per mole with an aromatic di-isocyanate in less than stoichiometric amount. Compositions of this type are disclosed in U.S. Pat. No. 4,346,205 herein incorporated by reference. Similar materials can be obtained commercially under the tradename Sorbothane® from Sorbothane, Inc. (Kent, Ohio 44240). Although it is a solid, Sorbothane® offers quasi-liquid properties which enable it to exhibit high mechanical damping and energy absorption. It is available in hardnesses ranging from about 70 on the Shore 00 Durometer scale to about 30. Sorbothane® itself can function as an effective pad in reducing the force of impact on the body, but its high density of about 1280 kilograms per cubic meter (~80 lbs/cubic foot) creates a very heavy pad which would be inconvenient to wear. By using Sorbothane® and similar high damping polyurethane compositions as an insert or inserts within the lightweight foam laminate of the current invention, high mechanical damping can be obtained while maintaining a relatively light weight pad.

(5) Curative polyurethane gels are often used to replicate the properties of human tissue and skin. They have excellent energy damping properties and resilience. One family of curative polyurethane gels are derived from 3 component liquid material systems comprising an "A" component described as an aromatic diisocyanate terminated glycol solution, a "B" component described as a polybutadiene polyol solution, and a "C" plasticizer component described as a mixture of dialkyl and alkyl carboxylates. A typical formulation is made up from 50 parts by weight "A"

component, 100 parts by weight "B" component, and from zero to 200% by weight of the total A/B mixture. Such gels are manufactured by BJB Enterprises, Inc. (Garden Grove, Calif. 92643) under the tradename Flabbercast™. Other families of curative polyurethane gels can be derived from different 3 liquid component systems. An example is Skinflex III™, also obtained from BJB Enterprises. In Skinflex III™, the "A" component is described as a aromatic diisocyanate terminated polyoxypropylene glycol mixture, the "B" component curing agent is described as a polyoldiamine mixture, and the "C" plasticizer component is described as a dialkylcarboxylate. The mix ratio is 50 parts "A" and 100 parts "B" by weight while the plasticizer "C" can be varied from zero to 50% of the total weight of "A" and "B".

Curative polyurethane gels have relatively high densities and pad inserts made from them can be heavy and add weight to the pad. It is possible to lower the weight of the inserts as much as 50% or more by the addition of hollow organic or inorganic fillers, for example hollow glass microspheres, to the gel before it is cured. Scotchlite™ Glass Bubbles (3M Co., St. Paul, Minn. 55144) are examples of suitable lightweighting fillers.

Figure 8:
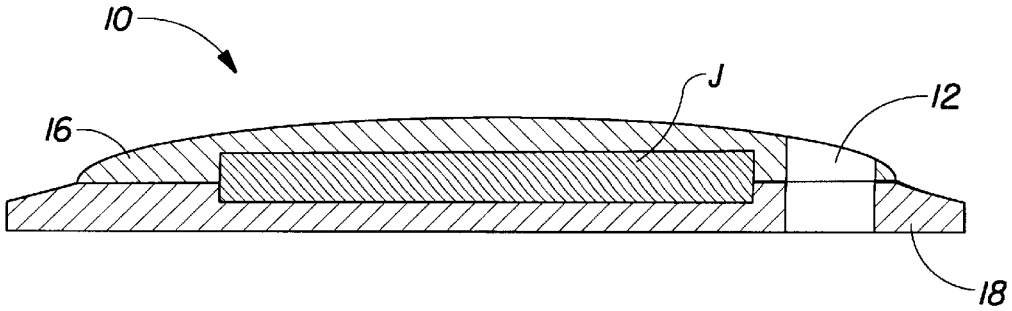
FIG. 8 is a partial cross-sectional view through lines 8—8 of FIG. 7.

Since it may be possible for plasticizer to migrate out of the curative polyurethane gel, it is generally preferred to fully encapsulate the gel insert between the low density and high density foam layers as shown in FIG. 8.

(6) High damping polyvinylchloride (PVC) plastisol gels are prepared from a major portion of plasticizer and a minor portion of PVC resin. Such plastisols are dispersions of special fine particle size PVC resins dispersed in plasticizing liquids. Additional components such as heat stabilizers, colorants, and other additives known to those skilled in the art of plastisols may also be included. In general, a plastisol is liquid at room temperature. Upon heating to a suitably high temperature, fusion occurs converting the plastisol into a tough homogeneous mass with excellent impact resistance. An example of one such material and its application in a shock absorbing bicycle seat is disclosed in U.S. Pat. No. 5,252,373 herein incorporated by reference. A suitable plastisol is "Plastomeric Plastisol M1430 Clear base" and a suitable plasticizer is "Plastomeric Type B Plasticizer". Both products are available from Plastomeric, Inc. Waukesha, Wis. according to whom, the M1430 Clear Base contains 53% PVC copolymer resin, 27% di-octyl terephalate, 2.5% epoxidized soybean oil, 3% calcium-zinc stabilizers, 7% PVC-based thixotrope, and 7.5% adipate plasticizer-based thixotrope.

The fusion temperature range of such plastisols lies between 275° F. and 400° F. which may lie above the softening points of the preferred polyolefin foams used in the laminated pad of this invention. Rather than fusing the liquid plastisol within the recess or recesses of the pad, it may be necessary to cast the liquid plastisol in a suitable metal or plastic mold, heat it to the fusion temperature where it fuses into a gel, and then insert the tough rubbery product into the pad recess or recesses. Since it may be possible for plasticizer to migrate out of the fused gel, it is generally preferred to fully encapsulate the gel insert between the low density and high density foam layers as shown in FIG. 8.

PVC plastisol gels have relatively high densities and pad inserts made from them can be heavy and add weight to the pad. It is possible to lower the weight of the inserts as much as 50% or more by the addition of hollow organic or inorganic fillers, for example hollow glass microspheres, to the gel before it is cured. Scotchlite™ Glass Bubbles (3M Co., St. Paul, Minn. are examples of suitable lightweighting fillers.

(7) Viscoelastic foams are open celled polyurethane-based materials offering high damping properties and high impact and shock absorption capability. The high damping engineered into these materials makes the foams response to mechanical stress highly sensitive to the rate of deformation. Under low loading rates, the foams slowly deform acting very much like a highly viscous fluid. Under high rates of deformation, as in the case of an impact, the foams act as much stiffer materials. Examples of such materials include the CONFOR™ family of viscoelastic foams available from AeroE.A.R. Specialty Composites (Indianapolis, Ind. 46268). These foams have densities ranging from about 92.8 to about 102.4 kilograms per cubic meter (about 5.8 to about 6.4 lbs/cubic foot) and room temperature Shore 00 Durometer hardnesses of about 20 or less.

Although viscoelastic foams themselves can make effective shock absorbing pads, they are open celled. This open celled structure will cause them to absorb large amounts of water if washed and make them very difficult to dry afterwards. For the pads of the present invention, it is preferred to fully encapsulate the viscoelastic foam insert between the low density and high density closed cell foam layers as shown in FIG. 8. The preferred thickness range of the viscoelastic foam insert is from about 6.35 mm to about 19.0 mm.

(8) Resilient thermoplastic honeycomb laminates consist of a thermoplastic honeycomb core material laminated between two plastic films through use of heat, adhesives or both. Examples of such honeycomb materials are available from Hexcel Corporation (Pleasanton, Calif. 94588) under the tradenames Cecore™ polypropylene and polyester thermoplastic honeycomb, Cecore™ Cush 'n Form polypropylene thermoplastic honeycomb, and TPU™ thermoplastic polyurethane honeycomb sandwich. TPU™ thermoplastic polyurethane honeycomb sandwich has a cell size of 6.35 mm and is available with film facings ranging in thickness from about 0.127 mm to 0.508 mm. For the pads of the current invention, the honeycomb sandwich used as the energy absorbing insert may consist of one layer about 12.77 mm thick or two layers each about 6.35 mm thick.

Comfort in wearing hip pads can be enhanced by garment design. The garment fabric can enhance breathability, particularly when combined with a pad with air flow openings. Fabrics which promote wicking of natural moisture away from the skin promote temperature regulation and comfort. "Cottonwick", manufactured by Colville Inc. of Winston Salem, N.C. is a particularly effective fabric for this purpose. It has a unique knit loop with polymerized silicone coating that wicks moisture into the fabric. The knit loop forms cone shaped capillaries and the silicone coating directs the moisture away from the surface of the fabric into the cones.

The pads of the current invention may be permanently affixed to the garment by, for example, sewing them into pockets such that the pads cannot be removed. Pads used in such a garment therefore need to be at least hand washable with the garment, and preferably machine washable. After washing, the garment and pads must be dried. Both line drying in room temperature air and machine drying with heated air are facilitated by the open areas in the pads which promote airflow through both the garment fabric and the pads. Alternatively, the garment may have pockets which are made openable and reclosable by means of zippers, snaps, hook and pile fasteners, and the like. This allows the pads to be removed from the garment such that the garment can be washed separately if desired.

The following examples are illustrative of the invention but are not limiting thereof:

EXAMPLE 1

Machined Foam Laminate Pad with Recess but without Insert

Figure 7:
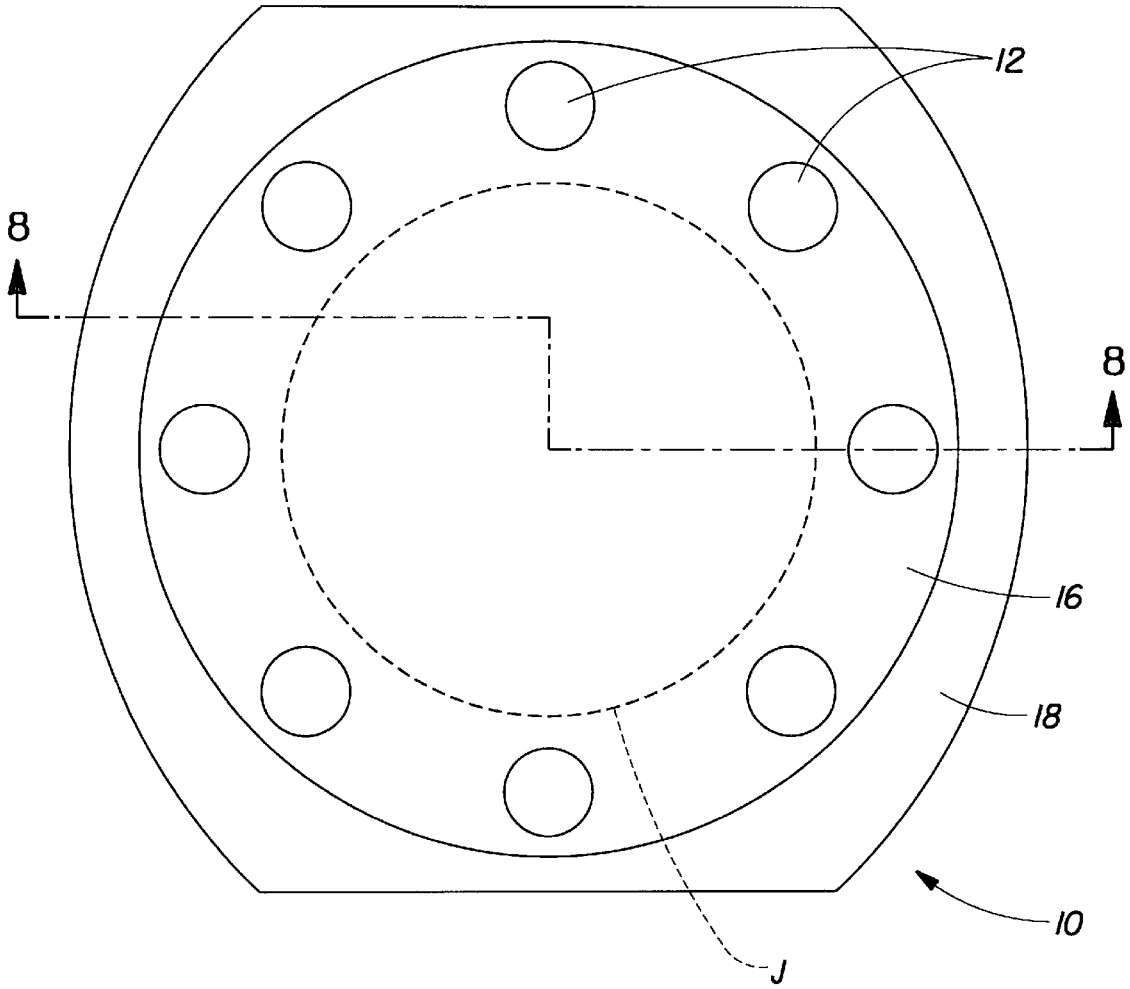
FIG. 7 is a plan view of another alternative embodiment of a protective pad of the current invention in which the insert is completely encapsulated by the high density and low density foam layers.

A multilayer pad is constructed by first die cutting a piece of MC3800 polyethylene foam (Sentinel Products Corporation, Hyannis, Mass. 02601) having a density of 64 kg per cubic meter from 6.35 mm thick sheet such that the piece has two straight sides opposite one another and parallel to one another and two curved sides opposite one another as shown in FIG. 7. Eight 12.7 mm diameter holes spaced around the piece are die cut at the same time. The distance between the straight sides is about 127 mm and the distance between the curved sides measured through the center of the piece is about 139.7 mm. This first piece is the skin or wearer side of the pad.

A second piece of foam, circular in shape and about 114.3 mm in diameter, is die cut from about 12.7 mm thick Minicell L1000 polyethylene foam (Voltek, Lawrence, Mass. 01843) having a density of about 160 pounds per cubic meter. This piece also has eight 12.7 mm diameter holes die cut at the same time and having the same spatial arrangement as in the first foam piece. A much larger hole, about 76.2 mm (3.0 inches) in diameter and positioned with its center coincident with the center of the piece, is also die cut at the same time. This second piece is the outside of the pad away from the wearer's body.

The two foam pieces are laminated together with 3M #343 double sided adhesive tape (3M Co., St. Paul, Minn. 55144) such that the eight 12.7 mm holes in each piece are aligned with one another. The laminated assembly is then mechanically machined using a cup shaped grinding wheel to provide smoothly tapering sides to the pad in all directions and to give the laminate a domed or curved cross section with the L1000 foam residing on the outermost or convex side of the pad. The finished pad weighs about 12 grams. This leaves a laminated pad having a recess about 76.4 mm in diameter and about 12.7 mm deep located at the center of the pad. The high density foam completely surrounds the recess while the low density foam forms the bottom of the recess. The maximum thickness is about 19 mm in the areas of the pad immediately adjacent to the recess tapering to about 3.18 mm or less around the pad perimeter.

The pad's ability to cushion against impact against a hard surface is measured on a surrogate hip, constructed from polyolefin and neoprene closed cell foams as well as other components, and designed to mimic both the soft tissue response and pelvic response of a human hip in a fall. The surrogate hip is dropped from a distance of about 37.5 cm such that its velocity upon impact with a horizontal steel plate is about 2.7 meters per second. The surrogate hip weighs approximately 35 kilograms and contains a surrogate femur and surrogate greater trochanter. A 5000 pound load cell (Product No. 8496-01, GRC Instruments, Santa Barbara, Calif. measures the force transmitted to the surrogate greater trochanter when the surrogate hip is dropped on the steel plate. The force measured on the surrogate trochanter when the unpadded surrogate hip is dropped and impacts the steel plate is about 6000 Newtons.

For comparison with the pads of this invention, a hip protector is removed from a SAFEHIP™ product (Sahvatex, Denmark), and mounted on the surrogate hip and held in place over the area of the surrogate greater trochanter by means of a stretch fabric covering the outer skin of the hip. When the padded surrogate hip is dropped and impacts the steel plate at 2.7 meters/second, the peak force measured on the surrogate trochanter is about 30% less than that measured with the unpadded surrogate hip. The SAFEHIP™ pad weighs about 31 grams, which puts the percent force reduction per gram weight of pad at about 1 percent/gram. However, this level of force reduction is well below the minimum 40% force reduction target of the pads of the present invention.

The pad of this Example is mounted on the surrogate hip and held in place over the area of the surrogate greater trochanter by means of a stretch fabric covering the outer skin of the hip. The pad recess is centered over the surrogate trochanter. When the padded surrogate hip is dropped and impacts the steel plate at 2.7 meters per second, the peak force measured on the surrogate trochanter is about 67% less than that measured with the unpadded surrogate hip. The force reduction per gram of pad weight is therefore about 5.58%/gram.

The pad of this example shunts most of the impact force to the areas surrounding the surrogate trochanter. The stiff high density foam surrounding the recess prevents the pad from bottoming out, and further prevents the surrogate skin and soft tissues overlying the trochanter to directly contact the steel plate during impact. However, when a pad of this construction is placed in the pockets of an undergarment and worn by a person under normal clothing, the outline of the recess is readily evident creating a strong negative impression of the pad/garment product.

EXAMPLE 2

Foam Laminate Pad with Polyolefin Foam Insert

A pad identical to that described in Example 1 is constructed. Into the 76.4 mm diameter and about 12.7 mm deep recess located at the center of the pad, a piece of Plastazote® LD60 low density (3.8 lbs/cubic foot) polyethylene foam (Zotefoams, Inc., Hackettstown, N.J. 07840) also about 76.4 mm in diameter and about 12.7 mm thick is attached by means of the same 3M #343 double sided adhesive tape (3M Co., St. Paul, Minn. 55144) used to laminate the foam layers. The completed pad weighs about 14 grams. When evaluated on the surrogate hip drop tester, with the insert centered over the surrogate trochanter, the peak force measured on the surrogate trochanter is about 66% less than that measured on the unpadded surrogate hip. The force reduction per gram of pad weight is therefore about 4.71%/gram.

EXAMPLE 3

Foam Laminate Pad with Sorbothane® Insert

A pad identical to that described in Example 1 is constructed. Into the 76.4 mm diameter and about 12.7 mm deep recess located at the center of the pad, a piece of Shore 00 Durometer 50 hardness Sorbothane® (from Sorbothane, Inc., Kent, Ohio 44240) high damping polyurethane also about 76.4 mm in diameter and about 12.7 mm thick is attached by means of the same 3M #343 double sided adhesive tape (3M Co., St. Paul, Minn. 55144) used to laminate the foam layers. The completed pad weighs about 95 grams. When evaluated on the surrogate hip drop tester, with the insert centered over the surrogate trochanter, the peak force measured on the surrogate trochanter is about 57% less than that measured on the unpadded surrogate hip. The force reduction per gram of pad weight is therefore about 0.60%/gram.

EXAMPLE 4

Foam Laminate Pad with Flabbercast™ Insert

A pad identical to that described in Example 1 is constructed. Into the 76.4 mm diameter and 12.7 mm deep recess located at the center of the pad, a liquid Flabbercast™ formulation (Garden Grove, Calif. 92643) comprising 50 parts by weight "A" component, 100 parts by weight "B" component, and enough "C" plasticizer to equal 100% by weight of the total A/B mixture is poured. The pad is set aside and the gel allowed to cure and solidify. On completion of the cure cycle, the completed pad weighs about 59 grams. When evaluated on the surrogate hip drop tester, with the insert centered over the surrogate trochanter, the peak force measured on the surrogate trochanter is about 69% less than that measured on the unpadded surrogate hip. The force reduction per gram of pad weight is therefore about 1.17%/gram.

EXAMPLE 5

Foam Laminate Pad with Lightweighted Flabbercast™ Insert

A pad identical to that described in Example 1 is constructed. Into the 76.4 mm diameter and 12.7 mm deep recess located at the center of the pad, a liquid Flabbercast™ formulation comprising 50 parts by weight "A" component, 100 parts by weight "B" component, enough "C" plasticizer to equal 100% by weight of the total A/B mixture, and about 15% Scotchlite™ Glass Bubbles (Product No. K15, 3M Co., St Paul, Minn. 55144) by total weight of the A/B/C mixture, is poured. The pad is set aside and the gel allowed to cure and solidify. On completion of the cure cycle, the completed pad weighs about 38 grams. When evaluated on the surrogate hip drop tester, with the insert centered over the surrogate trochanter, the peak force measured on the surrogate trochanter is about 66% less than that measured on the unpadded surrogate hip. The force reduction per gram of pad weight is therefore about 1.74%/gram.

EXAMPLE 6

Foam Laminate Pad with Polynorbornene High Damping Rubber Insert

A pad identical to that described in Example 1 is constructed. Into the 76.4 mm diameter and about 12.7 mm deep recess located at the center of the pad, a piece of Shore A Durometer 40 hardness polynorbornene high damping rubber (Rubber Associates, Inc., Barberton, Ohio) also about 76.4 mm in diameter and about 12.7 mm thick is attached by means of the same 3M #343 double sided adhesive tape (3M Co., St. Paul, Minn. 55144) used to laminate the foam layers. The completed pad weighs about 80 grams. When evaluated on the surrogate hip drop tester, with the insert centered over the surrogate trochanter, the peak force measured on the surrogate trochanter is about 42% less than that measured on the unpadded surrogate hip. The force reduction per gram of pad weight is therefore about 0.52%/gram.

EXAMPLE 7

Foam Laminate Pad with High Damping Butyl Rubber Insert

A pad identical to that described in Example 1 is constructed. Into the 76.4 mm diameter and about 12.7 mm deep recess located at the center of the pad, a piece of Shore A Durometer 40 hardness high damping butyl rubber (Rubber Associates, Inc., Barberton, Ohio 44203) also about 76.4 mm in diameter and about 12.7 mm thick is attached by means of the same 3M #343 double sided adhesive tape (3M Co., St. Paul, Minn. 55144) used to laminate the foam layers. The completed pad weighs about 80 grams. When evaluated on the surrogate hip drop tester, with the insert centered over the surrogate trochanter, the peak force measured on the surrogate trochanter is about 40% less than that measured on the unpadded surrogate hip. The force reduction per gram of pad weight is therefore about 0.50%/gram.

EXAMPLE 8

Foam Laminate Pad with Thermoplastic Polyurethane Honeycomb Sandwich Insert

A pad identical to that described in Example 1 is constructed. Into the 76.4 mm diameter and about 12.7 mm deep recess located at the center of the pad, two pieces about 6.35 mm thick TPU™ Thermoplastic Polyurethane Honeycomb Sandwich (Hexcel Corporation, Pleasanton, Calif. 94588) each piece having a cell size of about 6.35 mm and a nominal density of about 8 lbs/cubic foot and also about 76.4 mm in diameter and about 12.7 mm thick, are stacked on upon each other and attached to the pad by means of the same 3M #343 double sided adhesive tape (3M Co., St. Paul, Minn. 55144) used to laminate the foam layers. The completed pad weighs about 26 grams. When evaluated on the surrogate hip drop tester, with the insert centered over the surrogate trochanter, the peak force measured on the surrogate trochanter is about 56% less than that measured on the unpadded surrogate hip. The force reduction per gram of pad weight is therefore about 2.15%/gram.

EXAMPLE 9

Foam Laminate Pad with Viscoelastic Foam Insert

A pad identical to that described in Example 1 is constructed. Into the 76.4 mm diameter and about 12.7 mm deep recess located at the center of the pad, a piece of CONFOR™ CF-47 polyurethane foam (about 5.8 lbs./cubic foot and Shore 00 Durometer hardness of about 20) (AeroE.A.R Specialty Composites, Indianapolis, Ind. 46268) also about 76.4 mm in diameter and about 12.7 mm thick is attached by means of the same 3M #343 double sided adhesive tape (3M Co., St. Paul, Minn. 55144) used to laminate the foam layers. The completed pad weighs about 17 grams. When evaluated on the surrogate hip drop tester, with the insert centered over the surrogate trochanter, the peak force measured on the surrogate trochanter is about 66% less than that measured on the unpadded surrogate hip. The force reduction per gram of pad weight is therefore about 3.88%/gram.

EXAMPLE 10

Foam Laminate Pad with PVC Plastisol Gel Insert

A pad identical to that described in Example 1 is constructed. A sample of PVC plastisol gel is cut from a Model A10305 seat cushion marked with U.S. Pat. No. 5,252,373. obtained from Sports Med (Birmingham, Ala. 35222). A pad insert is fabricated by first heating the gel to a temperature of about 350 degrees F. in a beaker until it is liquified, then pouring the hot liquid into a circular metal mold about 76.4 mm in diameter and about 12.7 mm deep, and then allowing the gel to cool to room temperature whereupon it returns to its original soft gel state. The cooled gel, about 76.4 mm in diameter and about 12.7 mm thick, is removed from the mold and attached to the bottom of the 76.4 mm diameter and 12.7 mm deep recess located at the center of the pad by means of the same 3M #343 double sided adhesive tape (3M Co., St. Paul, Minn. 55144) used to laminate the foam layers. The completed pad weighs about 61 grams. When evaluated on the surrogate hip drop tester, with the insert centered over the surrogate trochanter, the peak force measured on the surrogate trochanter is about 71% less than that measured on the unpadded surrogate hip. The force reduction per gram of pad weight is therefore about 1.16%/gram.

What is claimed is:

1. A protective pad for protecting an area of the human body against impact forces, the pad having an inner surface, an outer surface, and a thickness, the pad comprising a first layer of high density closed-cell polymer foam, a second layer of low density closed-cell polymer foam, and at least one resilient energy absorbing insert, the layers and insert being fixed together to provide a lightweight pad, high resistance to impact forces, and comfort when applied to the area of the human body.

2. The pad of claim 1, wherein the insert consists of polyolefin foam, plastic foam, resilient rubber foam, high damping rubber, high damping polyurethane, curative polyurethane gel, high damping polyvinylchloride plastisol gel, viscoelastic foam, or resilient thermoplastic honeycomb laminate.

3. The pad of claim 2, wherein the polyolefin foam consists of low density polyethylene, linear low density polyethylene, medium density polyethylene, high density polyethylene, ethylene-vinyl acetate copolymer, ethylene methyl acrylate copolymer, ethylene ionomer, polypropylene, or polypropylene copolymer.

4. The pad of claim 2, wherein the resilient rubber foam consists of a foam made of natural rubber, butyl rubber, synthetic polyisoprene, polybutadiene, polynorbornene, styrene-butadiene, neoprene, nitrile rubber, polyurethane, or plasticized polyvinylchloride.

5. The pad of claim 2, wherein the high damping rubber consists of synthetic polyisoprene, natural polyisoprene, polybutadiene, butyl rubber, polynorbornene, ethylene-propylene diene monomer rubber, or styrene-butadiene rubber, combined with high levels of oils, plasticizers, or fillers.

6. The pad of claim 2, wherein the high damping polyurethane is formed by the reaction of slightly branched, substantially linear polyols having hydroxyl endgroups, and having average molecular weights in the range of from about 600 grams per mole to about 1200 grams per mole, with an aromatic di-isocyanate in less than the stoichiometric amount.

7. The pad of claim 2, wherein the curative polyurethane gel is derived from a three component liquid material system having an aromatic diisocyanate terminated glycol solution component, a polybutadiene polyol solution component, and a plasticizer component comprising a mixture of dialkyl and alkyl carboxylates.

8. The pad of claim 2, wherein the high damping polyvinylchloride plastisol gel is prepared from a dispersion of special fine particle size polyvinylchloride resin dispersed in a plasticizing liquid, and further comprising a major portion of plasticizer and a minor portion of polyvinylchloride resin.

9. The pad of claim 2, wherein the viscoelastic foam is an open-celled polyurethane-based material.

10. The pad of claim 2, wherein the thermoplastic honeycomb laminate is laminated between two plastic films.

11. The pad of claim 1, wherein the first layer has a density of from about 128 to about 192 kilograms per cubic meter, and the second layer has a density of from about 32 to about 80 kilograms per cubic meter.

12. The pad of claim 1, further comprising a plurality of score lines across the outer surface and partially through the thickness so as to provide substantial flexibility and conformability to the area of the human body covered by the pad, while maintaining significant resistance to impact forces.

13. The pad of claim 1, further comprising a plurality of open areas extending through the thickness so as to provide for breathability and dissipation of heat from the area of the human body covered by the pad, while maintaining significant resistance to impact forces.

14. The pad of claim 1, further comprising a garment attached to the pad, the garment comprising a fabric which promotes wicking of perspiration away from the body.

15. A protective pad, having at least one resilient energy absorbing insert, a thickness and a weight, for protecting a predefined area of the human body against impact forces and providing a force reduction of at least 40 percent, the pad being less than about 20 millimeters in thickness and less than about 100 grams in weight, the pad having a ratio of percentage force reduction per gram weight of the pad, as measured in a surrogate hip drop impact test, of from about 0.25 percent per gram to about 8.00 percent per gram.

16. The pad of claim 15, wherein the ratio is from about 0.40 percent per gram to about 6.00 percent per gram.

17. The pad of claim 16, wherein the ratio is from about 0.50 percent per gram to about 6.00 percent per gram.

18. A protective pad for protecting an area of the human body against impact forces, the pad having an inner surface, an outer surface, and a thickness, the pad comprising a first layer of relatively high density closed-cell polymer foam, a second layer of low density closed-cell polymer foam, and at least one resilient energy absorbing insert, the insert having a lower hardness than the first layer, the layers and insert being attached together to provide a lightweight pad, high resistance to impact forces, and comfort when applied to the area of the human body.

19. A protective pad for protecting an area of the human body against impact forces, the pad having an inner surface, an outer surface, and a thickness profile, the pad comprising a first layer of high density closed-cell polymer foam, a second layer of low density closed-cell polymer foam, and at least one resilient energy absorbing insert, the layers and insert being attached together to provide a lightweight pad, high resistance to impact forces, the thickness profile having smoothly tapering sides in all directions to define a domed cross section with the first layer residing on the convex side defined by the cross section to provide comfort when applied to the area of the human body.

20. The pad of claim 19, wherein the thickness profile tapers from a maximum pad thickness of about 19 mm to a perimeter thickness of about 6.35 mm or less.

21. A protective pad for protecting an area of the human body against impact forces, the pad having an inner surface, an outer surface, and a thickness profile, the pad comprising a first layer of high density closed-cell polymer foam, a second layer of low density closed-cell polymer foam, and at least one resilient energy absorbing insert, the insert having a lower hardness than the first layer, the layers and insert being attached together to provide a lightweight pad, high resistance to impact forces, the thickness profile having smoothly tapering sides in all directions to define a domed cross section with the first layer residing on the convex side defined by the cross section to provide comfort when applied to the area of the human body.

22. A protective pad for protecting an area of the human body against impact forces, the pad having an inner surface, an outer surface, and a thickness, the pad comprising a first layer of high density closed-cell polymer foam, a second layer of low density closed-cell polymer foam, and at least one non-resilient damping insert, the layers and insert being fixed together to provide a lightweight pad, high resistance to impact forces, and comfort when applied to the area of the human body.

23. The pad of claim 22, wherein the non-resilient damping insert comprises polystyrene foam.

* * * * *